US008975579B2

(12) United States Patent
Bream et al.

(10) Patent No.: US 8,975,579 B2
(45) Date of Patent: Mar. 10, 2015

(54) MASS SPECTROMETRY APPARATUS AND METHODS

(75) Inventors: David Bream, Winchester (GB); Christopher Newman, Emsworth (GB); Brian Christopher Webb, Salisbury (GB)

(73) Assignee: Ilika Technologies Limited, Southampton Hampshire (GB)

( * ) Notice: Subject to any disclaimer, the term of this patent is extended or adjusted under 35 U.S.C. 154(b) by 50 days.

(21) Appl. No.: 13/582,231

(22) PCT Filed: Mar. 2, 2011

(86) PCT No.: PCT/GB2011/000286

§ 371 (c)(1), (2), (4) Date: Aug. 31, 2012

(87) PCT Pub. No.: WO2011/107738

PCT Pub. Date: Sep. 9, 2011

(65) Prior Publication Data

US 2012/0318972 A1 Dec. 20, 2012

(30) Foreign Application Priority Data

Mar. 3, 2010 (GB) ..... 1003566.5
Jul. 1, 2010 (GB) ..... 1011103.7

(51) Int. Cl.
*H01J 49/40* (2006.01)
*H01J 49/34* (2006.01)
*H01J 49/44* (2006.01)

(52) U.S. Cl.
CPC ..... *H01J 49/34* (2013.01); *H01J 49/443* (2013.01)
USPC ..... 250/286; 250/290

(58) Field of Classification Search
CPC ..... H01J 49/062; H01J 49/443
USPC ..... 250/281–300
See application file for complete search history.

(56) References Cited

U.S. PATENT DOCUMENTS

| | | | | |
|---|---|---|---|---|
| 2,721,271 | A | 10/1955 | Bennett | |
| 3,582,648 | A * | 6/1971 | Anderson et al. | 250/287 |
| 4,458,149 | A * | 7/1984 | Muga | 250/287 |
| 5,818,055 | A | 10/1998 | Franzen | |
| 6,940,065 | B2 * | 9/2005 | Graber et al. | 250/282 |

(Continued)

FOREIGN PATENT DOCUMENTS

| | | |
|---|---|---|
| GB | 2376562 | 12/2002 |
| WO | 2004/021386 | 3/2004 |

OTHER PUBLICATIONS

International Search Report for corresponding patent application No. PCT/GB2011/000286 dated Aug. 2, 2011.

(Continued)

*Primary Examiner* — Jack Berman
*Assistant Examiner* — Eliza Osenbaugh-Stewart
(74) *Attorney, Agent, or Firm* — Renner, Otto, Boisselle & Sklar, LLP

(57) ABSTRACT

A mass spectrometer having a mass filter which applies a transient voltage profile to accelerate ion packets. The voltage profile is chosen to have a functional form which imparts each ion species with a kinetic energy which is larger the larger the mass-to-charge ratio and a velocity which is smaller the larger the mass-to-charge ratio. The ions are detected in an ion detector which discriminates between different ion species based on their kinetic energy and taking account of the functional form of the voltage profile. Suitable voltage profiles include periodic functions such as sinusoids, triangles and sawtooths, which allow the amplification of drive pulses in the mass filter to be carried out with narrow band amplification stages, which are simple and inexpensive to construct.

18 Claims, 8 Drawing Sheets

(56) References Cited

U.S. PATENT DOCUMENTS

| | | | | |
|---|---|---|---|---|
| 7,247,847 | B2 * | 7/2007 | Webb et al. | 250/293 |
| 2003/0066958 | A1 | 4/2003 | Okumura | |
| 2004/0206899 | A1 * | 10/2004 | Webb et al. | 250/281 |
| 2010/0252728 | A1 * | 10/2010 | Mackie et al. | 250/282 |

OTHER PUBLICATIONS

Yu W., Martin, "Enhancement of ion transmission at low collision energies via modifications to the interface region of a 4-sector tandem mass-spectrometer", Journal of the American Society for Mass Spectroscopy, 5(5), May 1994, pp. 460-469.

Birkinshaw K., "Advances in multidetector arrays for mass-spectroscopy—A LINK (JIMS) Project to develop a new high-specification array", *Transactions of the Institute of Measurement and Control*, 16(3), 1994, pp. 149-162.

Birkinshaw K., "Focal plane charge detector for use in mass spectroscopy", *Analyst*, 117(7), 1992, pp. 1099-1104.

* cited by examiner

MASS SPECTROMETRY APPARATUS AND METHODS

This application is a national phase of International Application No. PCT/GB2011/000286 filed Mar. 2, 2011 and published in the English language.

BACKGROUND OF THE INVENTION

The invention relates to mass spectrometers and methods of mass spectrometry.

A mass spectrometer is capable of ionising a neutral analyte molecule to form a charged parent ion that may then fragment to produce a range of smaller ions. The resulting ions are collected sequentially at progressively higher mass/charge (m/z) ratios to yield a so-called mass spectrum that can be used to "fingerprint" the original molecule as well as providing much other information. In general, mass spectrometers offer high sensitivity, low detection limits and a wide diversity of applications.

There are a number of conventional configurations of mass spectrometers including magnetic sector type, quadrupole type and time-of-flight type.

In a time-of-flight mass spectrometer the same kinetic energy is given to all ion species irrespective of mass-to-charge ratio. This is done by accelerating the ion packets in an electric field formed between an extraction grid electrode and an accelerator grid electrode. The amount of acceleration is dictated by the voltage difference between these two electrodes. For example, the accelerator electrode may be held at V=10 kV above the extraction grid electrode voltage. Another way of expressing the fact that all ion species are given the same kinetic energy is to say that the lighter, higher charge state ions are accelerated to a higher velocity and the heavier, lower charge state ions are accelerated to a lower velocity, i.e. the velocity is inversely proportional to mass-to-charge ratio, more precisely inversely proportional to the square root of mass-to-charge ratio m/z according to the equation:

$$\frac{1}{v} = \frac{1}{\sqrt{2V}}\sqrt{\frac{m}{z}}$$

where v is velocity, V is the voltage between the extraction and accelerator electrodes, m is the mass of the ion species and z is its charge.

More recently, one of the present inventors has developed a new type of mass spectrometer that operates according to a different basic principle, as described in U.S. Pat. No. 7,247,847B2 [1], the full contents of which are incorporated herein by reference. The mass spectrometer of U.S. Pat. No. 7,247,847B2 accelerates all ion species to nominally equal velocities irrespective of their mass-to-charge ratios to provide a so-called constant velocity or iso-tach mass spectrometer.

To accelerate all ion species to nominally equal velocities irrespective of their mass-to-charge ratios, the mass spectrometer of U.S. Pat. No. 7,247,847B2 is provided with a specially designed mass filter in which the electrodes are driven with an exponential voltage pulse, as schematically illustrated in FIG. 1. A packet of ions entering the electrode region therefore experience a time dependent instantaneous voltage $V_t$ which increases exponentially with time according to the formula $V_t=V_0 \exp t/\tau$ where $V_0$ is the voltage at t=0 and r is the exponential time constant. This contrasts from a time-of-flight design in which the accelerating voltage V is constant, i.e. time invariant. U.S. Pat. No. 7,247,847B2 refers to the mass filter as providing an "exponential box" for accelerating ions of an ion packet to substantially equal velocities. The mass filter (sometimes referred to as an analyser) comprises an electrode arrangement and a drive circuit, the drive circuit being configured to apply the exponential voltage profile to the electrode arrangement.

FIG. 2 shows a schematic diagram of the drive circuit 100 disclosed in U.S. Pat. No. 7,247,847B2. The drive circuit comprises three main functional parts. These are a low voltage waveform generator 102, a wideband amplifier 104 and a step-up transformer 106. The low voltage waveform generator 102 and the wideband amplifier 104 are used to produce an exponential pulse shape and the step-up transformer 106 is necessary to achieve the high voltages used to drive the mass spectrometer electrodes.

Although the drive circuit disclosed in U.S. Pat. No. 7,247,847B2 functions as required, it is relatively complicated and costly to build. In particular, the requirement to produce an exponential voltage pulse necessitates that the amplification stages have high bandwidth, since the exponential voltage pulse has its power spread over a wide frequency range.

SUMMARY OF THE INVENTION

According to one aspect of the invention there is provided a mass spectrometer comprising: an ion source configured to provide ion packets on demand, each comprising a plurality of ions with respective mass-to-charge ratios, those ions with a common mass-to-charge ratio being referred to as an ion species; a mass filter comprising an electrode arrangement arranged to receive the ion packets from the ion source, and a drive circuit operable to apply a voltage profile to the electrode arrangement, wherein the voltage profile has a functional form which imparts each ion species with a kinetic energy which is larger the larger the mass-to-charge ratio and a velocity which is smaller the larger the mass-to-charge ratio; and an ion detector arranged to receive the ions output from the mass filter and operable to discriminate between different ion species based on their kinetic energy and taking account of the functional form of the voltage profile.

In arriving at this design, the inventors have ignored the constant velocity or iso-tach "rule" of U.S. Pat. No. 7,247,847B2, but retained from that design the concept of separating ion species by kinetic energy in the mass filter, which allows the same detector approaches to be used as in U.S. Pat. No. 7,247,847B2, the only difference being that it is necessary to account for the functional form of the voltage profile used to accelerate the ions in the mass filter when mapping detected signal energies to mass-to-charge ratios. In particular, the departure from the constant velocity approach is not associated with any inherent loss of resolution. In other words, having a mass filter which spreads the ion species in velocity as well as kinetic energy does not lead to any inherent loss of resolution. An important consequence of the new design principle is that one is free to use a variety of functional forms of the voltage profile in the mass filter, and one is no longer tied to the exponential form that follows from the constant velocity "rule".

Typically the voltage profile used in the mass filter to accelerate the ions will vary monotonically. For example, the voltage profile may be linear.

The voltage profile may also be a periodic function, in which case a controller is used to control the ion source and the mass filter so that the ion source injects ion packets into the mass filter at a defined position in the periodic function, for example at a zero crossing, maximum, minimum, point of inflection, or some other feature of the function, or at any offset referenced from such a feature as defined in absolute time or degrees of the function's period.

For example, the periodic function may be a sine function, and the controller is provided to control the ion source and the mass filter so that the ion source injects ion packets into the mass filter when the voltage profile is at or close to a turning point of the sine function.

Other examples of suitable periodic function are a triangle function (alternating portions of positive and negative linear gradients), or a sawtooth function (repeated positive gradient portions connected by a sharp transient ideally of infinite gradient). Indeed either a triangle or sawtooth function is suitable for implementing a linear gradient voltage profile when used with appropriate gating by the controller to ensure that the ion source injects ion packets into the mass filter so that the ions of an ion packet experience a single gradient portion of the periodic function.

The drive circuit may comprise a voltage source in combination with an amplification device.

The invention also provides a method of mass spectrometry, the method comprising: generating packets of ions, each packet comprising a plurality of ions with respective mass-to-charge ratios, each comprising a plurality of ions with respective mass-to-charge ratios; injecting respective ion packets into a mass filter region defined by an electrode arrangement; and applying a voltage profile to the electrode arrangement, wherein the voltage profile has a functional form which imparts each ion species with a kinetic energy which is larger the larger the mass-to-charge ratio and a velocity which is smaller the larger the mass-to-charge ratio; and detecting ions accelerated by the voltage profile by discriminating between different ion species based on their kinetic energy and taking account of the functional form of the voltage profile.

A sine function is a particularly preferred voltage profile to be applied by the mass filter because it is easy in practice to make a source to synthesise a sinusoidal voltage profile, while at the same time the segment of a sine wave between $-\pi/2$ and 0, in particular between $-\pi/2$ and $-\pi/4$ approximates quite closely in its functional form to an exponential pulse of the form $V_t=V_0 \exp t/\tau$. A sine voltage profile is easy to synthesise, since it is of course of infinitely small bandwidth, by definition being composed of only a single frequency component. This makes it possible to use a very simple and inexpensive drive circuit for the mass filter electrodes, in essence just an oscillator, which could for example be provided by a simple tuned circuit, followed by a step-up transformer to increase the voltage.

It is also noted that the voltage pulse applied to the mass filter electrodes does not need to gate the ion packets in and out of the mass filter, since this can be done by other means, so the problem that the design needs to make sure only a segment of the sine wave acts on the ions can be overcome. Namely, the ion source can inject an ion packet into the mass filter at a desired time, and the ion packet will be accelerated to exit the mass filter after an amount of time defined by the functional form of the voltage pulse, so a sharp cut off in the pulse is not necessary.

Using a "sinusoidal box" mass filter in this way means that the mass spectrometer operates close to the iso-tach principle of the "exponential box" in that all ion species will be accelerated to roughly similar (but not equal) velocities, but there will be some weak dependency between velocity and mass-to-charge ratio as well.

The same gating approach can be used in other embodiments where a repeating wave form is used. For example, if a rising linear profile is desired as the active functional form, the voltage profile can be a triangle (i.e. tent or hat) one, with only a segment of the positive gradient portion of the triangle function being selected by appropriate gating of the ion packet injections.

In other words, the gating approach allows the mass filter to be driven with an uninterrupted periodic voltage profile, such as sinusoidal, triangle or sawtooth, with any desired portion of the function being selectable as the active part to apply to the ion packets.

According to one embodiment of the invention relating to the "sinusoidal box" approach there is provided a mass spectrometer comprising: an ion source configured to provide ion packets on demand, each comprising a plurality of ions with respective mass-to-charge ratios; an ion detector arranged to receive the ions; a mass filter comprising an electrode arrangement arranged between the ion source and the ion detector to define a mass filter region, and a drive circuit operable to apply a sinusoidal voltage profile to the electrode arrangement; and a controller operable to control the ion source and the mass filter so that the ion source injects ion packets into the mass filter region when the sinusoidal voltage profile is at or close to a turning point, i.e. its minimum at a phase of $-\pi/2$ for a spectrometer based on positive ions or its maximum at a phase of $+\pi/2$ for a spectrometer based on negative ions, whereby the ions are accelerated to approximately equal velocities irrespective of their mass-to-charge ratios.

In a preferred embodiment, the controller is operable to control the ion source and the mass filter so that the ion packets exit the mass filter region by the time that the sinusoidal voltage profile has reached its point of inflection, i.e. at a phase of 0 for a spectrometer based on positive ions or $\pi$ for a spectrometer based on negative ions, preferably by half the time between said turning point and said immediately subsequent point of inflection, i.e. by the time that the sinusoidal voltage profile has reached a phase of $-\pi/4$ for a spectrometer based on positive ions or $3\pi/4$ for a spectrometer based on negative ions, since it is these segments of the sine function that most closely approximate to an exponential function.

The drive circuit may comprise a sinusoidal wave source, which may be an analogue circuit or a digital circuit, preferably in combination with a suitable amplification device, such as a step-up transformer or voltage amplifier.

Using the "sinusoidal box" approach there is also provided a method of mass spectrometry, the method comprising: generating packets of ions, each packet comprising a plurality of ions with respective mass-to-charge ratios; injecting at controlled times respective ion packets into a mass filter region defined by an electrode arrangement; and applying a sinusoidal voltage profile to the electrode arrangement, wherein said controlled times for injecting the ion packets into the mass filter region are when the sinusoidal voltage profile is at or close to a turning point, i.e. its minimum at a phase of $-\pi/2$ for a spectrometer based on positive ions or its maximum at a phase of $+\pi/2$ for a spectrometer based on negative ions, so that ion packets passing through the mass filter region are accelerated to approximately equal velocities irrespective of their mass-to-charge ratios.

In the preferred embodiment, the controller is operable to control the ion source and the mass filter so that the ion packets exit the mass filter region by the time that the sinusoidal voltage profile has reached its point of inflection, i.e. at a phase of 0 or $\pi$, preferably by half the time between said turning point and said immediately subsequent point of inflection, i.e. by the time that the sinusoidal voltage profile has reached a phase of $-\pi/4$ for a spectrometer based on positive ions or $3\pi/4$ for a spectrometer based on negative ions, since it is these segments of the sine function that most closely approximate to an exponential function.

The injecting and applying steps are preferably carried out so that the ion packets exit the mass filter region by the time that the sinusoidal voltage profile has reached its point of inflection, i.e. at a phase of 0 for a spectrometer based on positive ions or it for a spectrometer based on negative ions, preferably by half the time between said turning point and said immediately subsequent point of inflection, i.e. by the time that the sinusoidal voltage profile has reached a phase of $-\pi/4$ for a spectrometer based on positive ions or $3\pi/4$ for a spectrometer based on negative ions, since it is these segments of the sine function that most closely approximate to an exponential function.

BRIEF DESCRIPTION OF THE DRAWINGS

For a better understanding of the invention and to show how the same may be carried into effect reference is now made by way of example to the accompanying drawings in which.

DETAILED DESCRIPTION

Figure 1:
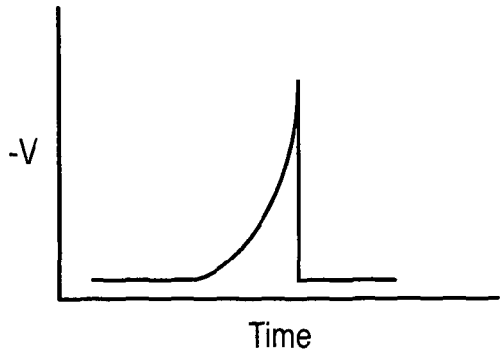
FIG. 1 (PRIOR ART)
FIG. 1 shows an exponential voltage pulse as used in a prior art mass filter.
Figure 2:
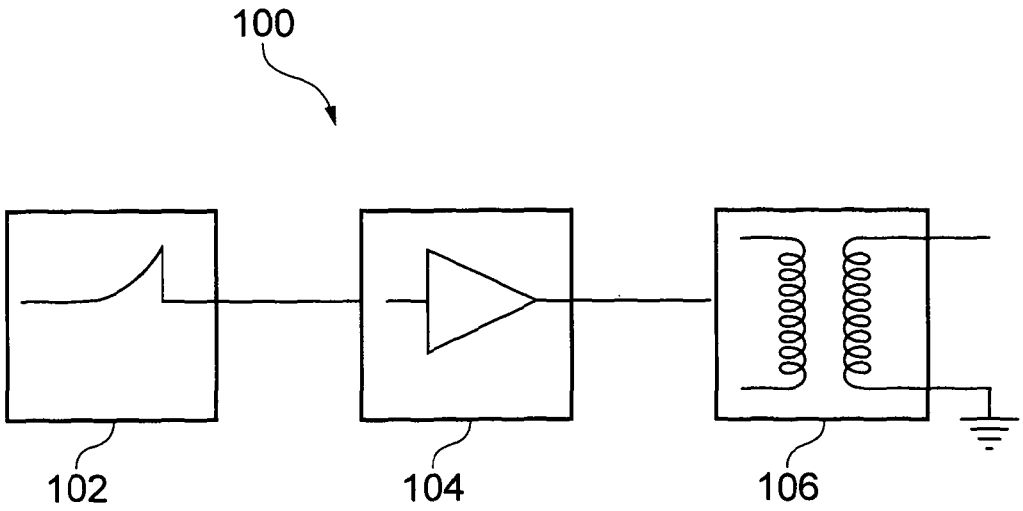
FIG. 2 (PRIOR ART)
FIG. 2 shows a schematic diagram of a prior art drive circuit suitable for the generation of exponential pulses.
Figure 3:
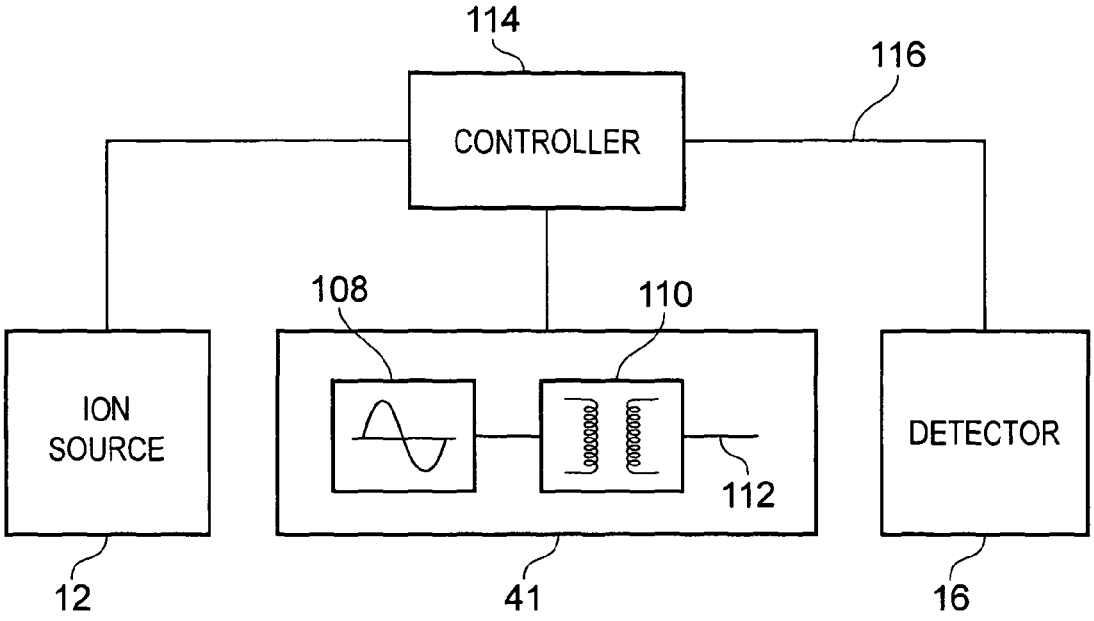
FIG. 3 shows a block diagram of a mass spectrometer according to a first embodiment of the present invention.

FIG. 3 shows a schematic of a drive circuit 41 of an embodiment of the present invention that could be used to control a so-called constant velocity mass spectrometer of the iso-tach type as disclosed in U.S. Pat. No. 7,247,847B2. The elements shown in FIG. 3 include an ion source 12, a detector 16 and the drive circuit 41, which are all electrically connected to controller 114. The controller 114 is used to control at least the ion source 12 and the drive circuit 41. The controller could also be used to control or receive the data from the detector 16. The controller is electrically connected to each of the ion source 12, drive circuit 41 and detector 16 via a series of control lines 116.

The drive circuit 41 comprises a low-voltage waveform generator 108 that is used to generate a sinusoidal wave. For example the waveform generator could be an oscillator. The waveform generator is electrically connected to a step-up transformer 110 to increase the output voltage of the waveform generator 108. Although the schematic of the drive circuit 41 shown in FIG. 3, comprises a step-up transformer 110 to increase the output voltage of the low voltage sinusoidal waveform generator 108, it will be appreciated that the same result could be achieved using a high voltage amplifier, for example a high voltage operational amplifier.

The drive circuit 41 of the present invention replaces the drive circuit disclosed in U.S. Pat. No. 7,247,847B2. The waveform that was produced by the drive circuit in U.S. Pat. No. 7,247,847B2 was a series of discrete exponential pulses. However, in the present invention the drive circuit 41, produces a continuous sinusoidal signal. Therefore, the controller 114 is used to synchronise various elements of the spectrometer, as will be described below.

The drive circuit 41 may be used to provide a fixed sinusoidal signal which is hardwired. The controller 114 is used to detect the sinusoidal signal, such that the ion source 12 and the detector 16 can be synchronised with the sinusoidal signal, as will be described below. Alternatively, the frequency and the amplitude of the sinusoidal signal could be adjusted by the controller 114, for example.

The controller 114 is used to control at least the ion source 12 and the drive circuit 41. This could be achieved by using a number of control lines, either serial or parallel, that are used to switch contacts to electrodes of the ion source 12 and the drive circuit 41 to provide the required supply voltages. Alternatively the control circuit may provide the voltages to each of the electrodes of the ion source 12 shown in FIG. 4 and described below. If the controller is used to control the detector 16, it may be used to control the detector electrodes and the detector array 56.

Figure 4:
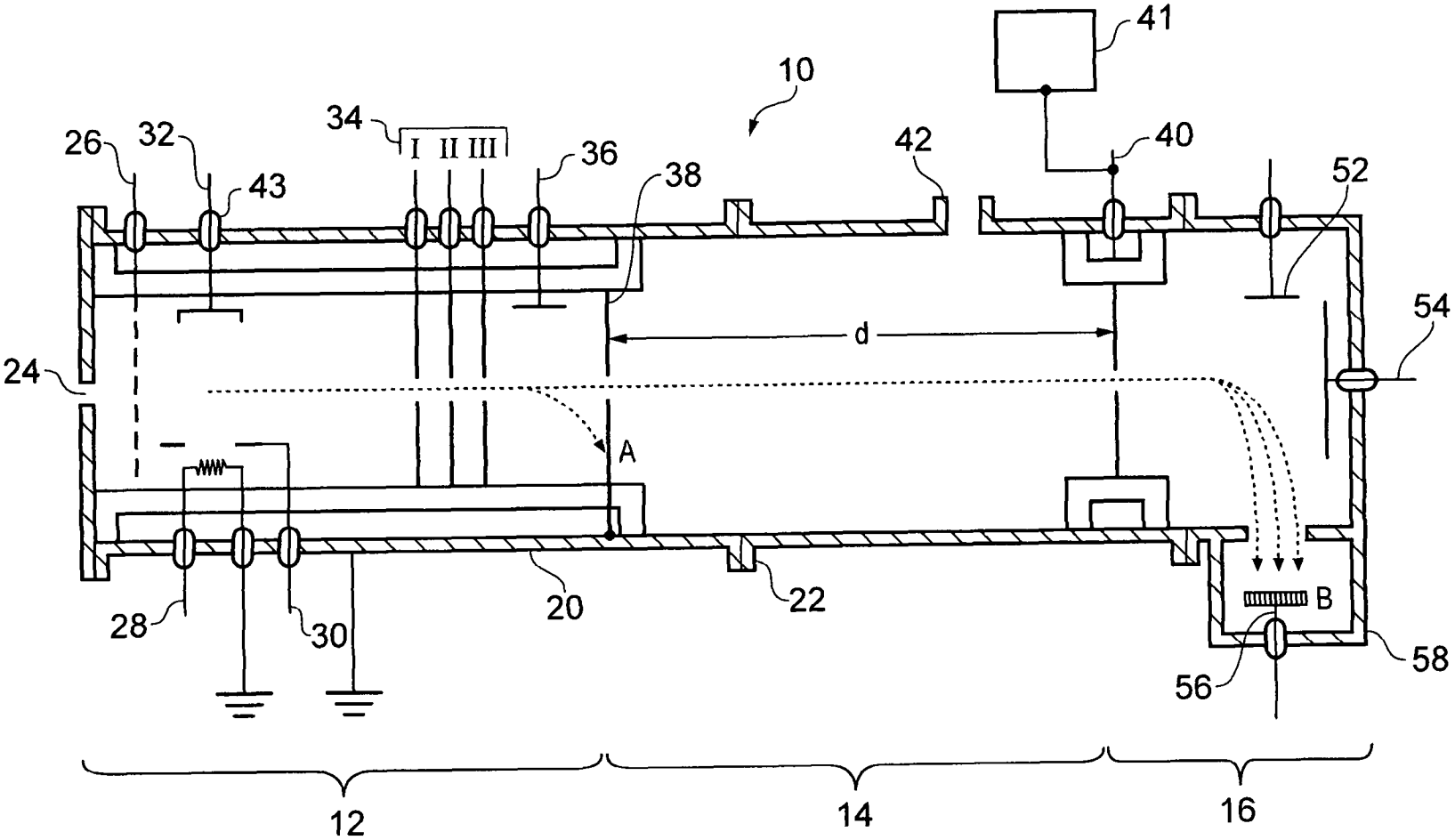
FIG. 4 shows a schematic cross-sectional view of the mass spectrometer of the first embodiment.

FIG. 4 shows a schematic cross-sectional view of a mass spectrometer that could be driven using the drive circuit 41 shown in FIG. 3. It will be appreciated that this is just an example of a mass spectrometer that could be controlled using the drive circuit 41 of the present invention, and other mass spectrometers that require a time varying voltage profile could equally be used.

The mass spectrometer will be described in terms of spectrometry of a gas, but the invention is equally applicable to non-gaseous analytes.

A mass spectrometer 10 has a body 20 formed primarily from stainless steel sections which are joined together by flange joints 22 sealed by O-rings (not shown). The body 20 is elongate and hollow. A gas inlet 24 is provided at one end of the body 20. A first ion repeller electrode 26 having a mesh construction is provided across the interior of the body 20, downstream of the gas inlet 24. The mesh construction is highly permeable to gas introduced through the gas inlet 24, but acts to repel ions when an appropriate voltage is applied to it.

An ioniser comprising an electron source filament 28, an electron beam current control electrode 30 and an electron collector 32 is located downstream of the first ion repeller electrode 26. The electron source filament 28 and the current control electrode 30 are located on one side of the interior of the body 20, and the electron collector 32 is located opposite them on the other side of the interior of the body 20. The features operate in the conventional fashion, in that, by the application of appropriate currents and voltages, electrons are generated by the source filament 28, collimated by the control electrode 30, and travel in a stream across the body 20 to the collector 32.

An ion collimator in the form of an Einzel lens 34 is located downstream of the ioniser. Einzel lenses are known in the art for collimating beams of ions [2]. Downstream of the lens 34 is a second ion repeller electrode 36, which is located on one side of the body 20 only, and an ion collector electrode 38 which is annular and extends across the body 20 and has an aperture for the passage of ions. The ion collector electrode 38 and the body 10 are both grounded.

The above-mentioned features can be considered together to comprise an ion source 12 which provides ions in a form suitable for being accelerated according to their mass-to-charge ratio. Each of the electrode terminals of the ion source 12 are controlled by the controller 114. Alternatively, all of the electrode terminals could be fixed to their respective voltages except for electrode 36 which will still be controlled by the controller 114 to synchronise the operation of the ion source 12 with the mass filter 14, as described below.

Situated downstream of the collector electrode 38 is a mass filter 14 comprising an electrode arrangement. The mass filter 14 extends for a length d, between the ion collector electrode 38 and a time varying pulse electrode 40. The time varying pulse electrode 40 is annular and has an aperture for the passage for ions. The drive circuit 41 is provided for applying time varying voltage profiles to the time varying pulse electrode 40, controlled using the controller 114. The controller 114 is in permanent communication with the drive circuit 41, such that the operation of the ion source 12 is synchronised with the operation of the mass filter 14, in the manner described below.

An outlet 42 is provided in the part of the body 10 which defines the outer wall of the mass filter 14. The outlet 42 permits connection of a vacuum system by means of which the pressure in the interior of the mass spectrometer 10 can be reduced to the required operating pressure, typically no higher than 1.3 Pa (~$10e^{-3}$ torr). However, the pressure in the interior of the mass spectrometer 10 can be reduced to $1.3\times 10^{-2}$ Pa (~$10e^{-5}$ torr), which is usual for a mass spectrometer. The outlet 42 may alternatively be situated at the end of the body 20, near the gas inlet 24.

More generally it is an advantage of this and other embodiments that the device only needs a short flight path for ions, i.e. a short distance between the ion source and the ion detector, compared with for example a time of flight mass spectrometer. As a consequence, the device can operate with a relatively poor vacuum, i.e. at relatively high pressures, which is particularly advantageous for portable devices.

In U.S. Pat. No. 7,247,847B2 the term "exponential box" was used to refer to the mass filter 14, since the mass filter 14 was driven using a train or series of pulses, each with an exponential rising portion terminating in an abrupt cut-off to zero voltage. However, since in the present invention the mass filter 14 will be driven using a continuous sinusoidal wave, the mass filter 14 will be referred to as a "sinusoidal box". The dimensions of the sinusoidal box 14 can be defined by the length d between the ion collector electrode 38 and the time varying pulse electrode 40 and the area enclosed by these electrodes.

The time varying pulse electrode 40 of the sinusoidal box is connected to the output 112 of the drive circuit 41. As described above the controller 114 communicates with the drive circuit 41, such the ion source 12 can be synchronised with the mass filter 14.

Beyond the time varying pulse electrode 40, the mass spectrometer 10 terminates with an ion detector 16. A pair of repeller electrodes 52, 54 are located downstream of the time varying pulse electrode 40. The first electrode 52 is located to the side of the ion path and the second electrode 54 is located at the end wall of the mass spectrometer, effectively in the ion path. The two electrodes 52, 54 are substantially orthogonal, and together form an ion disperser. A detector array 56 is provided in a detector box 58. The box 58 is external to the grounded body 10, and has an aperture to allow the passage of ions from the body 10 to the detector array 56. The detector array 56 is located opposite to the first repeller electrode 52. Ion detector arrays are known in the art [3,4].

The voltages applied to each of the electrodes of the detector 16 and the array detector 56 are controlled using the controller 114. Alternatively, the actual drive voltages for each of the electrodes of the detector 16 could be provided by the controller 114. Since, the voltages of each the electrodes are fixed it is preferred that the controller is not used to control the electrodes. However, in this instance the array detector could be controlled by the controller 114, such that its operation can be synchronised with the sinusoidal box.

The electrodes are all mounted on electrode supports 43 which are fabricated from suitable insulator materials such as ceramic or high density polyethylene (HDPE).

Operation of the mass spectrometer 10 in combination with the drive circuit 41 will now be described.

Gas which is to be analysed is admitted into the interior of the mass spectrometer 10 at low pressure via the gas inlet 24. No means of gas pressure reduction is shown in the Figures, but there are many known techniques available, such as the use of membranes, capillary leaks, needle valves, etc. The gas passes through the mesh of the first ion repeller electrode 26.

The gas is then ionised by the stream of electrons from the electron source filament 28, to produce a beam of positive ions. The electrons are collected at the electron collector 32, which is an electrode set at a positive voltage with respect to the current control electrode 30, to give electrons near the axis of the ion source, shown by the dotted line in FIG. 4, an energy of about 70 eV. This is generally regarded as being about the optimum energy for electron impact ionisation, as most molecules can be ionised at this energy, but it is not so great as to produce undesirable levels of fragmentation. The precise voltage applied to the electron collector 32 would normally be set by experiment but will probably be of the order of 140 V. It should be appreciated that there are many possible designs of electron impact ionisation source and, indeed, other methods of causing ionisation.

Any gas which is not ionised by the stream of electrons will pass through the mass spectrometer 10 and be pumped away by the vacuum system connected to the outlet 42. A flanged connection is suitable.

The dotted line referred to above also indicates the passage of ions through the mass spectrometer 10. A positive voltage is applied to the first ion repeller electrode 26, to repel the (positive) ions and direct them through the Einzel lens 34 so as to produce a narrow, parallel ion beam. A positive voltage is applied to the second ion repeller electrode 36, so that the ion beam is deflected by the second ion repeller electrode 36. The deflected ions, which follow the dotted path labelled 'A' in FIG. 4, are collected at the ion collector electrode 38, which is grounded to prevent build-up of space charge.

To allow ions to enter the mass filter, the voltage on the second ion repeller electrode 36 is periodically set to 0 V to allow a small packet of ions to be undeflected so that they enter the sinusoidal box 14 through the aperture in the ion collector electrode 38. In this way, the second ion repeller electrode 36 and the ion collector electrode 38 form a pulse generator for generating packets of ions. This pulse generation is synchronised with the output signal of the drive circuit 41. To ensure that the ions entering the sinusoidal box are synchronised with the sinusoidal signal, the controller 114 is used.

A mathematical comparison of a sine wave with an exponential function shows that the region or segment of a sine wave that most closely resembles an exponential rise is that between a phase of $-\pi/2$ to 0, more particularly between $-\pi/2$ and $-\pi/4$. Therefore, a packet of positive ions need to be injected into the sinusoidal-box when the sinusoidal driving signal is at or at least close to a phase of $-\pi/2$. As described above the controller communicates with the drive circuit 41, such that a 0 voltage is applied to the electrode 36 (part of the ion source 12), to allow a packet of positive ions to enter the sinusoidal box at a point when the sinusoidal driving signal is at a phase of $-\pi/2$.

It will be appreciated that practically it might not be possible to inject the ion packet in the mass filter 14 when the sinusoidal drive signal is at $-\pi/2$. By injecting the ion packets close to this point, also referred to as the minimum in the sinusoidal voltage profile, it might be within 10 degrees, preferably 5, 4, 3, 2 or 1 degrees of the minimum, either before or after the minimum time.

The maximum voltage is designated as $V_{max}$. (Since the ions are, in this case, positively charged, the sinusoidal wave will be negative going. It would need to be positive going in the case of negatively charged ions.) The effect on the ions of the increasing electric field resulting from the time varying voltage pulse is to accelerate them at an increasing rate towards the time varying pulse electrode 40. Ions with the smallest mass have the lowest inertia and will be accelerated more rapidly, as will ions bearing the largest charges, so that ions with the lowest m/z ratios will experience the largest accelerations. Conversely, ions with the largest m/z ratios will experience the smallest accelerations. After t seconds all of the ions have traveled the distance d and passed the time varying pulse electrode 40. Hence, the ions are separated spatially according to their m/z ratios, with the lightest ions leading as these have experienced the greatest acceleration and have therefore traveled the distance d most quickly. Because the ions have different masses, they have different kinetic energies.

In U.S. Pat. No. 7,247,847B2 an exponential was used so theoretically all of the ions would have an equal velocity. However, since the sinusoidal signal used in the present invention will deviate from an exponential, the ions will not all be at equal velocities. Nevertheless, a spread of kinetic energies will be imparted to ions of different masses, so ion species are distinguishable at the detector on the basis of their different kinetic energies in the same way conceptually way as in the iso-tach design of U.S. Pat. No. 7,247,847B2.

The kinetic energy is given by the well-known equation $E=mv^2/2$, so that the kinetic energy is not simply proportional to mass as in the iso-tach design, since the mass filter does not apply an exponential voltage pulse to the ions, but rather a voltage pulse derived from a monotonic segment of a sinusoid. The sinusoid segment applied to accelerate the ion packet is known from the operational timings dictated by the controller. From the known voltage pulse shape, a functional relationship can be deduced between ion species, i.e. m/z ratio, and exit kinetic energy (and velocity) from the mass filter. Therefore, the sinusoidal-box 14, like the exponential-box of the prior art, allows ions to be distinguished according their m/z ratios on the basis of the kinetic energies imparted to them in the mass filter.

The fact that the ions exit the sinusoidal box with a spread of velocities, unlike the exponential box from which they emerge with equal velocities, merely changes the functional relationship between m/z ratio and kinetic energy, but since this functional relationship is known from the known voltage function, it can be fully taken account of at the detector without any loss of resolution. In other words, the departure from the iso-tach principle of the exponential box design is not fundamentally associated with any loss of resolution. However, conceptually, the operating principle of the sinusoidal box design remains more akin to the exponential box design, since in both cases the ion species are being separated and distinguished in kinetic energy. Both the sinusoidal box and exponential box designs remain conceptually different from a time of flight mass spectrometer, which is based on separating and distinguishing ion species based on velocity differentials being applied by the mass filter which allow the ion species to be distinguished at the detector based on arrival time after sufficient separation in the drift tube.

The precise values of the voltages which need to be applied to the various electrodes depends on the exact geometry adopted in the mass spectrometer 10. An example of a set of suitable voltages is as follows:

| | | |
|---|---|---|
| Ion repeller electrode | | +10 V |
| Electron collector | | +140 V |
| Einzel lens | I | +5 V |
| | II | +3 V |
| | III | +4 V |
| Ion repeller electrode | | +60 V |

Once the ions have left the sinusoidal box, they must be detected according to their m/z ratio, so that the mass spectrum for the gas can be derived.

As the sinusoidal box 14 accelerates ions according to their m/z ratio by giving them different kinetic energies, the ion detector 16 can operate by differentiating between the ions on the basis of their kinetic energy. This approach is different from that used in conventional time of flight mass spectrometers which employ an ion detector that differentiates between ions of different mass on the basis of their different velocities and hence arrival times.

The ion detector 16 shown in FIG. 4 operates as follows:

Steady positive voltages are applied to the repeller electrodes 52, 54, which create a curved electric field. As the ions leave the sinusoidal box 14, they enter this curved field, which acts to deflect the ions towards the detector array 56, where they are detected. The amount of deflection, and hence the ion trajectories through this field, will be determined by the energy of the ions, and they will therefore be dispersed over the detector array 56 according to their m/z ratios. The geometric arrangement of the repeller electrodes 52, 54, and the voltages applied to them, together determine the range of m/z ratios that can be detected and the resolution that is achieved. The mass spectrum is obtained from the detector array signal in a conventional manner.

A suitable voltage to be applied to the repeller electrodes 52, 54 is of the order of +400 V. However, the voltages required to be applied to the repeller electrodes 52, 54 depends upon their exact size, shape and placement in a working device. Values between +300 V and +500 V may be used in different situations. The figure of +400V should be seen therefore as illustrative only. Moreover, negative values will of course be used if the polarities are reversed.

While a result can be obtained for a single ion packet with this ion detector 16, successive packets can be accumulated so as to improve the signal to noise ratio and, thereby, the sensitivity of the spectrometer. Alternatively this ion detector can be used to obtain time-resolved data.

Figure 5:
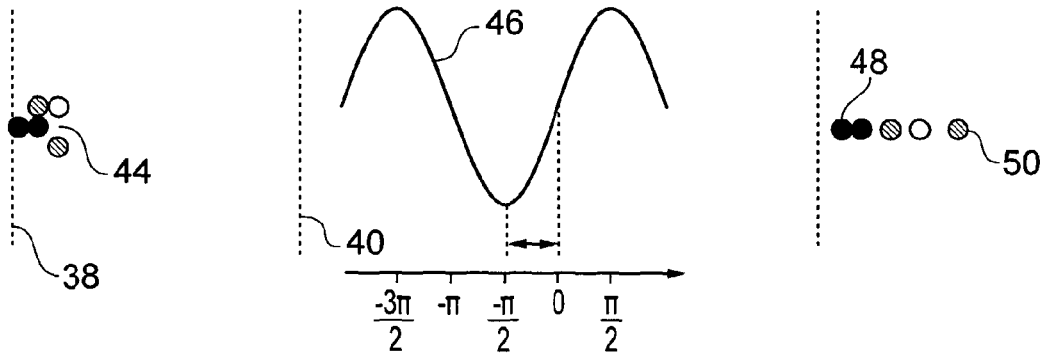
FIG. 5 is a schematic view of an ion packet before and after acceleration in a mass filter of the first embodiment.

FIG. 5 illustrates the principle of the sinusoidal box 14 schematically. A packet of ions 44 enters the sinusoidal box at the ion collector electrode 38, which has a zero applied voltage. The ions then travel to the time varying pulse electrode 40 to which the time varying voltage profile 46 (in this case a sinusoidal waveform which, as previously mentioned, is negative going since the ions are positive) is applied by the drive circuit 41. After passing the time varying pulse electrode, the ions are spatially separated, with the heaviest ion 48 (largest m/z ratio) at the rear and the lightest ion 50 (lowest m/z ratio) at the front.

It will be appreciated that the time varying voltage electrode 40 will be constantly driven using a sinusoidal wave, as discussed above. However, the ion packet will only be allowed to enter the sinusoidal box at a specific point of the sinusoidal wave signal. In this example, the time at which the ion packet will be allowed to enter the sinusoidal box is illustrated on the voltage profile 46 in FIG. 5, as discussed above. This is typically at a phase of $-\pi/2$ or the minimum of the sinusoidal waveform.

In U.S. Pat. No. 7,247,847B2, the exponential pulse used to drive the mass filter is a series of discrete pulses, each of which are terminated using a sharp cut-off. Since, a sinusoidal wave is used in the present invention, there is no sharp cut-off. Therefore, the spectrometer, the drive circuit 41 and the controller 114 should be operated such that all of the ions in the ion packet injected into the mass filter have exited, i.e. departed or left, the detector 16, before the sinusoidal wave reaches a phase of 0. In order to prevent further deviation from the exponential driving signal used in U.S. Pat. No. 7,247,847B2 it is preferred that all of the ions in the ion packet exited the ion filter before the sinusoidal wave reaches a phase of $-\pi/4$.

In the above detailed description we have assumed that a positive ion mass spectrometer is being considered, unless the sign of the ions has been explicitly mentioned. It will be understood that even though negative ion mass spectrometry is less commonly employed, the principles of the present invention can equally well be applied to negative ions. In such a case, the polarities of the electric fields described herein would need to be reversed, which in effect means that the ion packets need to be injected into the mass filter at a phase at or close to $+\pi/2$ (rather than $-\pi/2$) and should exit by a phase of $+\pi$ (rather than 0) more preferably $+3\pi/4$ (rather than $-\pi/4$).

It will be appreciated that although only a single sinusoidal source has been described above, it may be desirable to use one or more additional sinusoidal sources of higher frequencies, specifically with integer multiples of the base or fundamental frequency, wherein the different frequency components are superposed and collectively applied to the mass filter electrodes. This may allow a closer functional approximation to an exponential to be achieved over a given time segment while still retaining the ability to use simple low cost narrow band width amplification for each frequency component.

Figure 6:
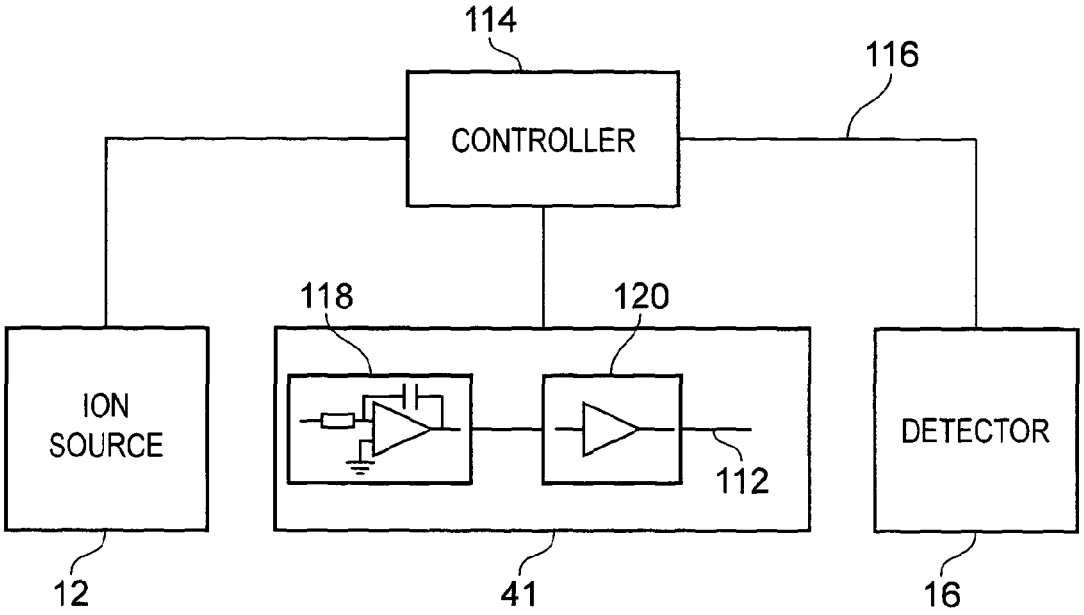
FIG. 6 shows a block diagram of a mass spectrometer according to a second embodiment of the present invention.

FIG. 6 shows a schematic of a drive circuit 41 of another embodiment of the present invention. The elements shown in FIG. 6 that are common with those elements shown in FIG. 3 are identified using the same reference numerals. The elements of the drive circuit 41 that are common to FIG. 3 have the same functionality.

In FIG. 6 the drive circuit 41 comprises an operational-amplifier integrator or integrator 118 and an amplifier 120. The drive circuit 41 of the present embodiment replaces the drive circuit disclosed in U.S. Pat. No. 7,247,847B2. In the present embodiment of the invention the drive circuit 41 produces a linearly increasing voltage signal, or linear voltage signal for short. Therefore, the controller 114 is used to synchronise various elements of the mass spectrometer.

The drive circuit 41 is used to control the integrator 118 by applying a negative voltage to the input of the integrator 118 to produce a monotonically increasing voltage signal. It will be appreciated that a monotonically decreasing voltage signal could be achieved using a positive drive signal. The amplitude of the input signal applied to the integrator 118 may be used to vary the rate of change of the output signal. The integrator may also include a reset, so that the output signal from the integrator 118 can be reset before or when the integrator 118 has reached saturation. A reset may be in the form of a voltage controlled switch connected in parallel with the feedback capacitor of the integrator 118.

The controller 114 is used to synchronise the ion source 12 and the detector 16 with the linear voltage signal. In other words after the integrator 118 is reset and a signal is applied to the input of the integrator 118, the controller 114 is used to control at least the ion source 12 and the drive circuit 41.

In this embodiment, the term linear box is used to describe the mass filter in analogy to the terms sinusoidal box used above to describe the first embodiment and exponential box used to describe the "iso-tach" prior art.

For a linear voltage signal applied to electrode 40 in the linear box 14, the ions leaving the linear box 14 will typically have a spread of velocities. The important feature is that the ion species still have kinetic energies imparted to them that follow a defined functional relationship from light to heavy ions, with the heavier ions having more kinetic energy than the lighter ions, or more precisely including charge state, the higher m/z ratio ions having more kinetic energy than the lower m/z ratio ions.

The components of the integrator 118 will be known and the voltage applied to the input of the integrator 118 will be controlled by the controller 114, therefore it is possible to determine the output of the integrator using known calculations. Accordingly it is possible to determine the shape and values of the voltage signal that is applied to the linear box 14. Since the shape of the voltage signal is known, it is possible to calculate the energy that is imparted to the ions of a particular mass and therefore, calculate their mass. For example, numeral integration could be used. As described above, once the ions have left the linear box, they are detected according to their m/z ratio, so that the mass spectrum for the analyte can be derived. As the linear box 14 accelerates ions according to their m/z ratio by giving them different energies, the ion detector 16 can operate by differentiating between the ions on the basis of their kinetic energy.

Figure 7:
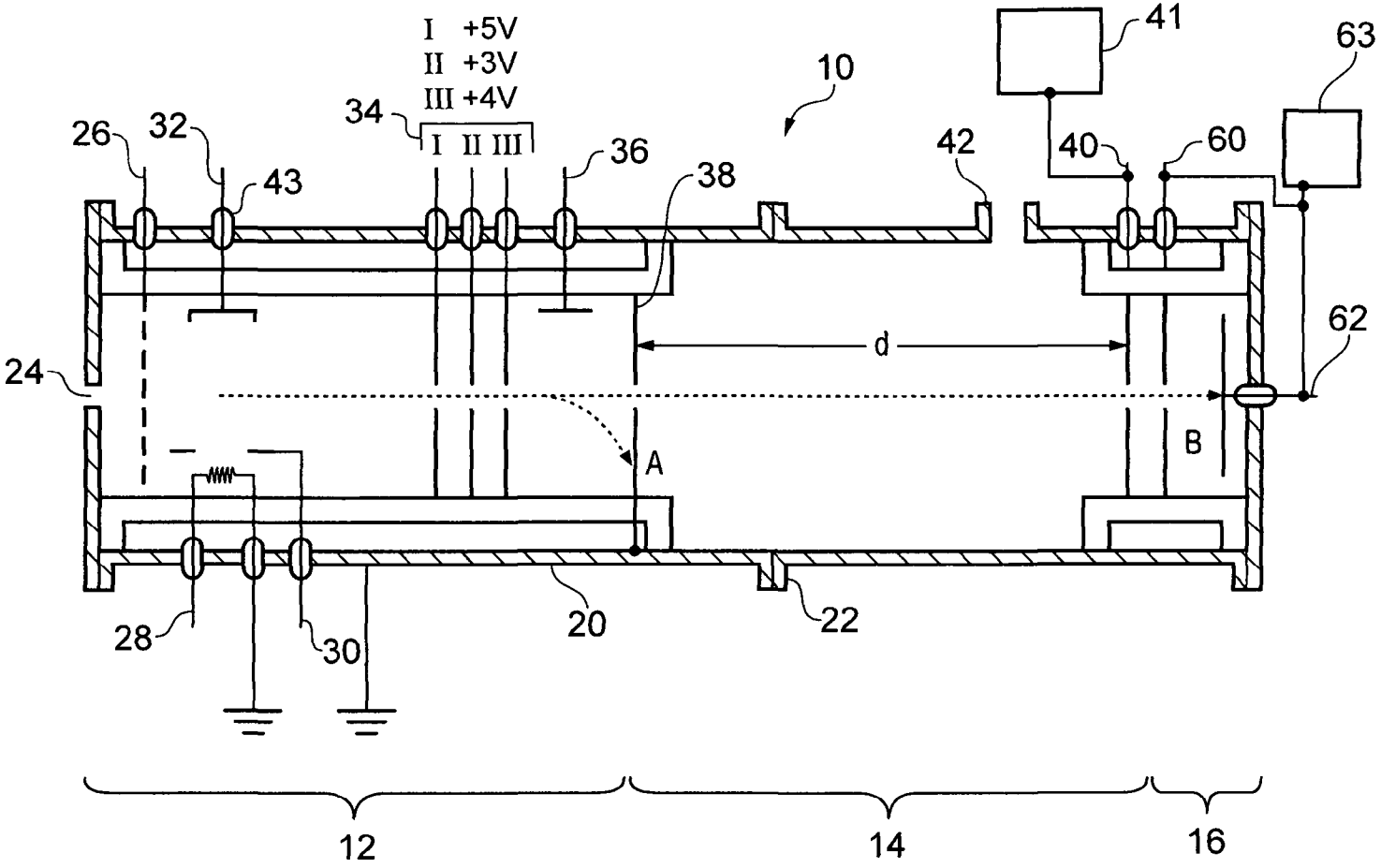
FIG. 7 shows a schematic cross-sectional view of the mass spectrometer of the second embodiment.

FIG. 7 is a schematic cross-section of the mass spectrometer which employs a different type of ion detector 16 from that of embodiment shown in FIG. 4. A first detector electrode 60 is located downstream of the exponential pulse electrode 40 which is annular with an aperture for the passage of ions. This electrode 60 acts as an energy selector. Following this, a second detector electrode 62 is located in the ion path. This is in effect a single element detector, and may be, for example, a Faraday cup. A voltage supply 63 is provided for applying voltages to the first detector electrode 60 and the second detector electrode 62.

In use, the first detector electrode 60 and the second detector electrode 62 are set to a potential of $V_t+V_r$ volts, where $V_t$ is the time varying voltage profile as defined above, and $V_r$ is a bias voltage selected to repel, or reflect, ions having energies less than $V_r$ electron volts. Hence, only ions having energies equal to or greater than $V_r$ electron volts pass through the first detector electrode 60 and reach the second detector electrode for detection. An alternative arrangement omits the first detector electrode, so that ions are repelled at the second detector electrode immediately before non-repelled ions are detected.

To obtain a set of mass spectrum data, $V_r$ is initially set to zero, so that all the ions in a packet are detected. For the next packet, $V_r$ is increased slightly to reflect the lowest energy ions, and allow the remainder to be detected. This process is repeated, with $V_r$ increased incrementally for each packet, until the field is such that all ions are reflected and none are detected. The data set of detected signals for each packet can then be manipulated to yield a plot of ion current against m/z ratios, i.e. the mass spectrum.

Alternatively, the ion detection can be carried out by starting with a high value of $V_r$ with repels all the ions. $V_r$ is then reduced for each successive ion packet until $V_r$ is zero and all ions in a packet are detected. Indeed, as long as $V_r$ is swept over a number of different values corresponding to the full range of ion energies, the detection procedure can be carried out in any arbitrary sequence. All that is required is that the complete range of ion energies of interest is covered during the detection procedure. The resolution of this ion detector can be altered as required by changing the number of measurements with different values of $V_r$ which are made. A larger number of measurements over a given ion energy range gives better resolution. Also, it is also possible to set the ion detector to particular voltages, or narrow voltage ranges, in order to concentrate on one or more narrow m/z regions.

Figure 8:
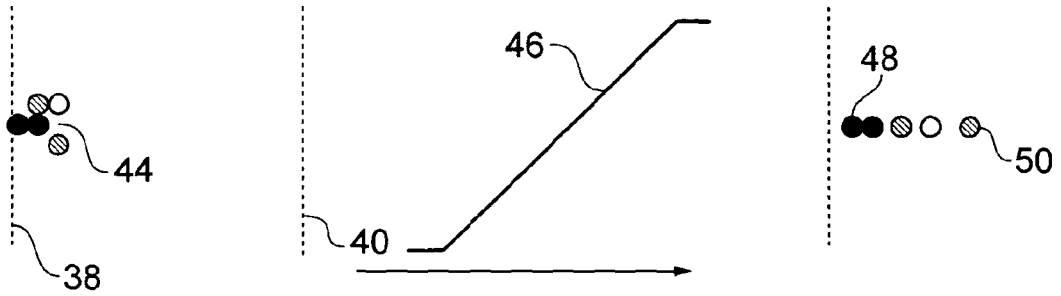
FIG. 8 is a schematic view of an ion packet before and after acceleration in a mass filter of the second embodiment.

FIG. 8 illustrates the principle of the linear box 14 schematically when drive by the drive circuit 41 shown in FIG. 6. A packet of ions 44 enters the linear box at the ion collector electrode 38, which has a zero applied voltage. The ions then travel to the time varying pulse electrode 40 to which the linear voltage profile 46 is applied by the drive circuit 41. After passing the linear pulse electrode, the ions are spatially separated, with the heaviest ion 48 (largest m/z ratio) at the rear and the lightest ion 50 (lowest m/z ratio) at the front.

In a variant of the linear box embodiment, the linear waveform can be produced with a frequency modulated train of pulses of constant amplitude, short duration, and increasing repetition frequency. The repetition frequency increases linearly. A series or sequence of pulses of this type gives an effect entirely equivalent to a linear pulse, because the time average of the pulses corresponds to a linear function. Another variant would be to provide a pulse sequence with constant repetition frequency and linearly increasing pulse amplitude, which would also provide a linear function. A frequency modulated pulse train is suitable for use to generate periodic waveforms such as the above-mentioned sawtooth and triangle functions. A frequency modulated pulse train can also be used to generate other functional forms as desired to implement further embodiments of the invention. It is noted that the frequency modulated pulse train approach was already suggested previously in connection with the prior art exponential box design of U.S. Pat. No. 7,247,847B2 [1].

In embodiments of the invention, the drive circuit 41 has been described as driving the electrode 40 at the exit of the sinusoidal or linear box 14 and the electrode 38 at the entrance to the linear box 14 is connected to 0 volts. However, it will be appreciated that it is possible to reverse these two, such that the drive circuit 41 drives the electrode 38 at the entrance to the sinusoidal or linear box and the electrode 40 at the exit of the sinusoidal or linear box 14 is connected to 0 volts. It will be appreciated that in this case the drive voltage will need to have its polarity reversed compared with the previous embodiments in order to maintain the correct field gradient in the box. The ions are thereby pushed towards the detector rather than being pulled, i.e. attracted, towards it.

It will also be appreciated that further embodiments are possible in which the detector scheme of FIG. 4 is used in the linear box embodiment and the detector scheme of FIG. 7 is used in the sinusoidal box embodiment.

Figure 9A:
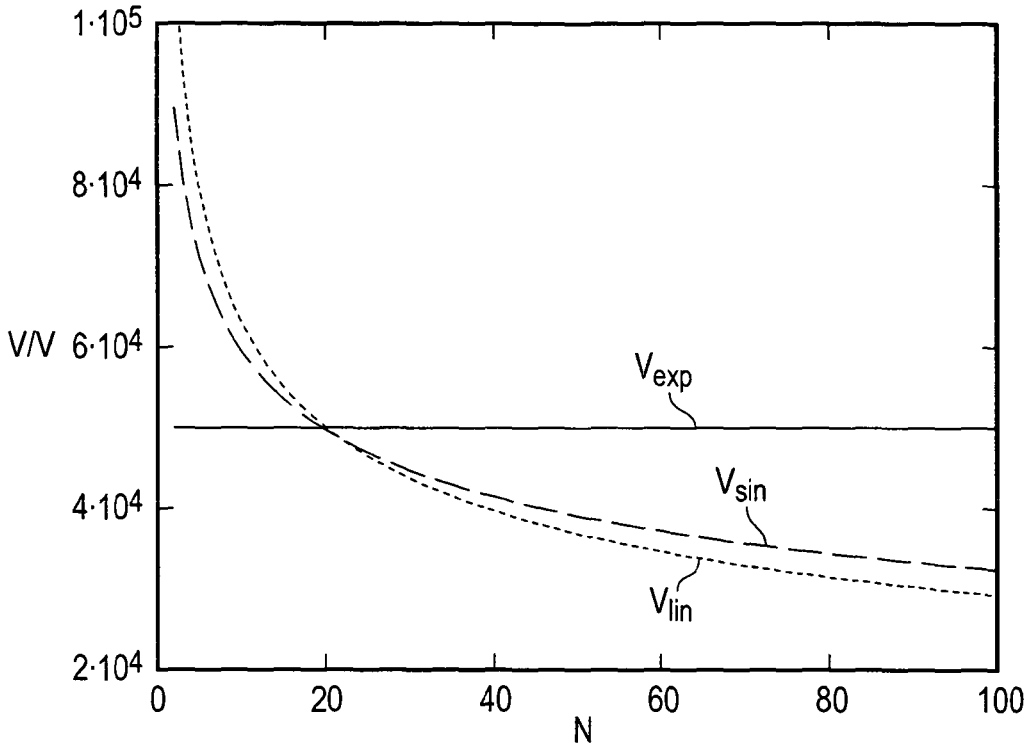
FIG. 9A is a plot of ion exit velocity from the mass filter as a function of ion mass number for the prior art, first embodiment and second embodiment.
Figure 9B:
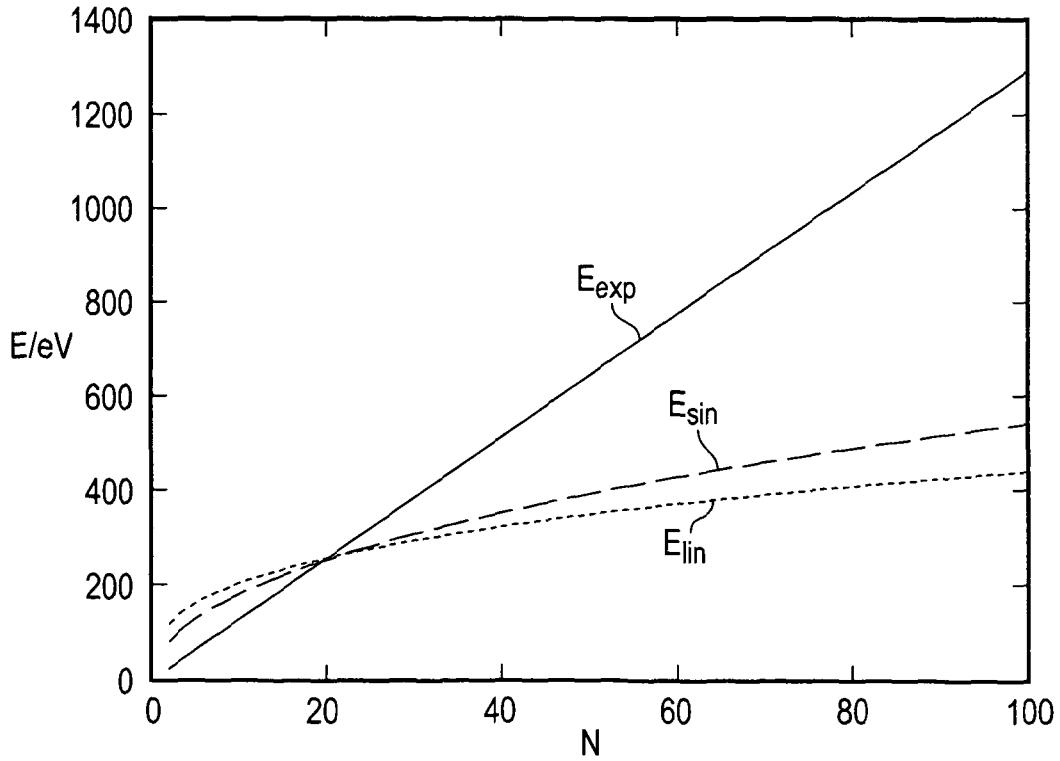
FIG. 9B is a corresponding plot of ion energy as a function of ion mass number.

FIGS. 9A and 9B are graphs illustrating the relative performance of the linear box embodiment, the sinusoidal box embodiment, and the exponential box of U.S. Pat. No. 7,247,847B2 [1]. FIG. 9A is a plot of ion exit velocity V in m/s from the mass filter as a function of ion mass number N assuming a single electronic charge $q=1.602\times10^{-19}$ C. FIG. 9B is a corresponding plot of ion energy E in eV at the exit of the mass filter as a function of ion mass number N, also assuming a single electronic charge. All examples take an electrode separation distance of $d=5\times10^{-2}$ m as shown in FIGS. 4 and 7 between the electrodes 38 and 40. The exponential box characteristics in FIGS. 9A and 9B are shown by the solid lines, $V_{exp}$, $E_{exp}$ respectively. The sinusoidal box characteristics in FIGS. 9A and 9B are shown by the long dashed lines, $V_{sin}$, $E_{sin}$ respectively. The linear box characteristics in FIGS. 9A and 9B are shown by the short dashed lines, $V_{lin}$, $E_{lin}$ respectively. For the exponential example, the time constant was taken to be $\tau=1\times10^{-6}$ $s^{-1}$. For the linear example, the ramp rate was taken to be $R=1.15\times10^{8}$ V/s. For the sinusoidal example, the wave frequency was taken to be $\omega=1.6\times10^{5}$ Hz and the wave amplitude $v_0=2000$ V. In both plots the curves are normalised to a mass number of 20 for ease of visual comparison. Respective derivations of the equation for velocity as a function of mass-to-charge ratio for sinusoidal and linear voltage profiles are provided in Appendices A and B, these being the functions plotted in FIG. 9A. The function plotted in FIG. 9B follows straightforwardly from the familiar relation between kinetic energy, mass and velocity, i.e. $E=\frac{1}{2}mv^2$.

The exponential box characteristics show that the mass filter accelerates all ion species to equal velocity and that the kinetic energy imparted to the ion species scales linearly with mass number, since of course kinetic energy is proportional to mass, and the velocities are all the same. By contrast the sinusoidal and linear voltage pulses produce more complicated functional relationships which are generally similar to each other in that low mass ions are accelerated to higher velocities than high mass ions (FIG. 9A) and low mass ions are imparted lower kinetic energy than high mass ions (FIG. 9B). Importantly, both linear and sinusoidal voltage profiles give a monotonic function for energy as a function of mass number, so that at the ion detector an arrival energy is uniquely associated with a mass number (or more generally a mass-to-charge ratio). However, the energy resolution, and hence the mass resolution, is not as good as for the exponential box, as evidenced by the smaller gradient of the E(N) curves. Comparing the linear and sinusoidal curves in this respect, the sinusoidal box provides a larger gradient, i.e. a better energy or mass resolution, than the linear box. Generating a sinusoidal voltage function will also in general be achievable with simpler electronics than a linear voltage function, although both are much simpler to implement than an exponential voltage function.

With the sinusoidal voltage profile, the ions will most efficiently be injected into the mass filter to be timed to coincide with minima of the sine function. Injection may take place on every cycle or once every nth cycle where n is an integer, e.g. every second or third cycle. With a linear voltage profile, a periodic sawtooth can be used, or a sawtooth having dwell times of any desired length between pulses, which may be equal to provide a synchronous, periodic function, or asynchronous. Injection of ions will most efficiently take place at the base of each linear ramp. A sawtooth does have an advantage over a sinusoid in that three-quarters of the time during the sinusoid is dead time during which ions cannot be accelerated while it is waited for the sinusoid to return to its minimum. The used portion of the sinusoid is from the minimum to the point of inflexion a quarter of a cycle later. By contrast, a sawtooth can be provided with no dead time in the case that at the top of the ramp the signal drops immediately back to the bottom of the ramp. The sawtooth thus intrinsically has four times the ion packet throughput of a comparable sinusoid, and the same as a repeated exponential voltage profile as contemplated in the prior art U.S. Pat. No. 7,247,847B2 [1].

APPENDIX A

Acceleration Using a Sinusoidal Voltage Profile

An ion of mass m and charge +q placed in an electric field E, between two electrodes will experience an acceleration given by:

$$\frac{d^2 s}{dt^2} = \frac{qE}{m} \tag{1}$$

where s is the distance traveled by the ion in time t.

If the two electrodes are a distance, d, apart and the voltage applied between the electrodes at any moment is $V_t$, then the expression for the acceleration becomes:

$$\frac{d^2 s}{dt^2} = \frac{qV_t}{md}$$

If the voltage applied to the electrodes is sinusoidal in function, with amplitude $V_0$ and frequency ω rad/s, such that $V_t$=0 at t=0 and $V_t$ is always positive, then:

$$V_t = V_0[1-\cos(\omega t)]$$

and the acceleration of the ion may be expressed as:

$$\frac{d^2 s}{dt^2} = \frac{qV_0}{md}[1-\cos(\omega t)] \tag{2}$$

The instantaneous velocity, $v_t$, may then be found by integrating equation 2 as follows:

$$v_t = \frac{ds}{dt} = \frac{qV_0}{md}\left[t - \frac{\sin(\omega t)}{\omega}\right] + C \tag{3}$$

where C is a constant of integration

If the velocity of the ion is zero at t=0 then from equation 3, C=0

Rearranging equation 3 and making C=0 gives an expression for the ion's velocity at time t:

$$v_t = \frac{qV_0}{md\omega}[\omega t - \sin(\omega t)] \tag{4}$$

The distance traveled, s, may then be found by a further integration:

$$s = \frac{qV_0}{md\omega}\left[\frac{\omega t^2}{2} + \frac{\cos(\omega t)}{\omega}\right] + C' \tag{5}$$

where C' is a second constant of integration

Rearranging equation 5 gives:

$$s = \frac{qV_0}{md\omega^2}\left[\frac{\omega^2 t^2}{2} + \cos(\omega t)\right] + C' \tag{6}$$

By definition, s=0 at t=0 therefore from equation 5, $$C' = \frac{-qV_0}{md\omega^2} \tag{7}$$

Substituting 7 in 6 gives the expression for the distance traveled by the ion after time t:

$$s = \frac{qV_0}{md\omega^2}\left[\frac{\omega^2 t^2}{2} + \cos(\omega t) - 1\right] \tag{8}$$

Expanding equation 8 by substituting the first 5 terms of the MacLaurin series for cos(ωt) gives:

$$s = \frac{qV_0}{md\omega^2}\left[\frac{\omega^2 t^2}{2} - 1 + \left(1 - \frac{\omega^2 t^2}{2} + \frac{\omega^4 t^4}{24} - \frac{\omega^6 t^6}{720} + \frac{\omega^8 t^8}{40320}\right)\right] \tag{9}$$

Rearranging equation 9 gives:

$$s = \frac{qV_0}{md\omega^2}\left[\frac{\omega^4 t^4}{24} - \frac{\omega^6 t^6}{720} + \frac{\omega^8 t^8}{40320}\right)\right] \tag{10}$$

Then, to a first approximation (ignoring the higher order terms):

$$s = \frac{qV_0}{md\omega^2} \cdot \frac{\omega^4 t^4}{24}$$

Rearranging gives:

$$s = \frac{qV_0\omega^2}{24md} t^4 \tag{11}$$

At the time, $t_e$, at which the ion reaches the more negative electrode, the distance traveled by the ion will be d, the distance apart of the electrodes.

Substituting d for s in equation 11 therefore gives:

$$d = \frac{qV_0\omega^2}{24md} t_e^4 \tag{12}$$

Rearranging 12 gives an expression for the exit time, $t_e$:

$$t_e = \left[\frac{24md^2}{qV_0\omega^2}\right]^{\frac{1}{4}} \tag{13}$$

Substituting the expression for exit time (equation 13) in the velocity equation (4) gives the following expression for the exit velocity, $v_e$:

$$v_e = \frac{qV_0}{md\omega}\left[\left(\frac{24\omega^2 md^2}{qV_0}\right)^{\frac{1}{4}} - \sin\left(\frac{24\omega^2 md^2}{qV_0}\right)^{\frac{1}{4}}\right]$$

APPENDIX B

Acceleration Using a Linear Voltage Profile

An ion of mass m and charge +q placed in an electric field E, between two electrodes will experience an acceleration given by:

$$\frac{d^2 s}{dt^2} = \frac{qE}{m} \quad 1$$

where s is the distance traveled by the ion in time t.

If the two electrodes are a distance, d, apart and the voltage applied between the electrodes at any moment is $V_t$, then the expression for the acceleration becomes:

$$\frac{d^2 s}{dt^2} = \frac{qV_t}{md}$$

If the voltage applied to the electrodes is initially zero and increases linearly with time at a rate R, then:

$$V_t = Rt$$

and the expression for the acceleration of the ion becomes:

$$\frac{d^2 s}{dt^2} = \frac{qRt}{md} \quad 2$$

The instantaneous velocity, $v_t$, may then be found by integrating equation 2 as follows:

$$v_t = \frac{ds}{dt} = \frac{qRt^2}{2md} + C \quad 3$$

where C is a constant of integration

If the velocity of the ion is zero at t=0 then from equation 3, giving:

$$v_t = \frac{qRt^2}{2md} \quad 4$$

The distance traveled, s, may then be found by a further integration:

$$s = \frac{qRt^3}{6md} + C' \quad 5$$

where C' is a second constant of integration

By definition, s=0 at t=0 therefore from equation 5, C'=0, giving:

$$s = \frac{qRt^3}{6md} \quad 6$$

At the time, $t_e$, that the ion reaches the more negative electrode, the distance traveled by the ion will be d, the distance apart of the electrodes.

Substituting d for s and $t_e$ for t in equation 6 therefore gives:

$$d = \frac{qRt_e^3}{6md} \quad 7$$

Substituting 4 in 7 gives:

$$d = v_e \frac{t_e}{3} \quad 8$$

where $v_e$ is the ion velocity at time $t_e$

Rearranging 8 gives:

$$t_e = \frac{3d}{v_e} \quad 9$$

Substituting 9 in 4 gives:

$$v_e = \frac{9qRd}{2mv_e^2}$$

Rearranging gives:

$$\frac{m}{q} = \frac{9Rd}{2v_e^3} \quad 10$$

showing that the mass/charge ratio is inversely proportional to the cube of the exit velocity.

REFERENCES

[1] U.S. Pat. No. 7,247,847B2

[2] "Enhancement of ion transmission at low collision energies via modifications to the interface region of a 4-sector tandem mass-spectrometer", Yu W., Martin S. A., Journal of the American Society for Mass Spectroscopy, 5(5) 460-469 May 1994

[3] "Advances in multidetector arrays for mass-spectroscopy—A LINK (JIMS) Project to develop a new high-specification array", Birkinshaw K., *Transactions of the Institute of Measurement and Control,* 16(3), 149-162, 1994

[4] "Focal plane charge detector for use in mass spectroscopy", Birkinshaw K., *Analyst,* 117(7), 1099-1104, 1992

The invention claimed is:

1. A mass spectrometer comprising:

an ion source configured to provide ion packets on demand, each comprising a plurality of ions with mass-to-charge ratios, those ions with a common mass-to-charge ratio being referred to as an ion species;

a mass filter having a length and comprising an electrode arrangement arranged to receive the ion packets from the ion source, and a drive circuit operable to apply a time-varying voltage profile to the electrode arrangement such that the ions of the received ion packets travel the length of the mass filter through a spatially uniform time-varying electric field, wherein the voltage profile has a functional form which imparts each ion species with a kinetic energy which is larger the larger the mass-to-charge ratio and a velocity which is smaller the larger the mass-to-charge ratio; and an ion detector arranged to receive the ions output from the mass filter and operable to discriminate between different ion species based on their kinetic energy and taking account of the functional form of the voltage profile.

2. The mass spectrometer of claim 1, wherein the voltage profile varies monotonically.

3. The mass spectrometer of claim 1, wherein the voltage profile is linear.

4. The mass spectrometer of claim 1, wherein the voltage profile is a periodic function, and a controller is provided to control the ion source and the mass filter so that the ion source injects ion packets into the mass filter at a defined position in the periodic function.

5. A mass spectrometer comprising:

an ion source configured to provide ion packets on demand, each comprising a plurality of ions with mass-to-charge ratios, those ions with a common mass-to-charge ratio being referred to as an ion species;

a mass filter comprising an electrode arrangement arranged to receive the ion packets from the ion source, and a drive circuit operable to apply a voltage profile to the electrode arrangement, wherein the voltage profile has a functional form which imparts each ion species with a kinetic energy which is larger the larger the mass-to-charge ratio and a velocity which is smaller the larger the mass-to-charge ratio; and an ion detector arranged to receive the ions output from the mass filter and operable to discriminate between different ion species based on their kinetic energy and taking account of the functional form of the voltage profile;

wherein the voltage profile is a periodic function, and a controller is provided to control the ion source and the mass filter so that the ion source injects ion packets into the mass filter at a defined position in the periodic function; and wherein the periodic function is a sine function, and the controller is operable to cause the ion source to inject ion packets into the mass filter when the voltage profile is at or close to a turning point of the sine function.

6. The mass spectrometer of claim 5, wherein the controller is operable to control the ion source and the mass filter so that the ion packets exit the mass filter by the time that the sine function has reached a point of inflection after said turning point.

7. The mass spectrometer of claim 6, wherein the ion packets exit the mass filter by half the time between said turning point and said point of inflection.

8. The mass spectrometer of claim 5, wherein the turning point is a minimum at a phase of $-\pi/2$ and wherein said ions are positive ions.

9. The mass spectrometer of claim 5, wherein the turning point is a maximum at a phase of $+\pi/2$ and wherein said ions are negative ions.

10. A method of mass spectrometry, the method comprising:

generating packets of ions, each packet comprising a plurality of ions with mass-to-charge ratios, those ions with a common mass-to-charge ratio being referred to as an ion species;

injecting respective ion packets into a mass filter region having a length defined by an electrode arrangement;

applying a time-varying voltage profile to the electrode arrangement such that the ions of the injected ion packets travel the length of the mass filter through a spatially uniform time-varying electric field, wherein the voltage profile has a functional form which imparts each ion species with a kinetic energy which is larger the larger the mass-to-charge ratio and a velocity which is smaller the larger the mass-to-charge ratio; and detecting ions accelerated by the voltage profile by discriminating between different ion species based on their kinetic energy and taking account of the functional form of the voltage profile.

11. The method of claim 10, wherein the voltage profile varies monotonically.

12. The method of claim 10, wherein the voltage profile is linear.

13. The method of claim 10, wherein the voltage profile is a periodic function, and the ion packets are injected into the mass filter at a defined position in the periodic function.

14. The method of claim 13, wherein the periodic function is a sine function, and the ion packets are injected into the mass filter when the voltage profile is at or close to a turning point of the sine function.

15. The method of claim 14, wherein the injecting and applying steps are carried out so that the ion packets exit the mass filter region by the time that the sine function has reached a point of inflection after said turning point.

16. The method of claim 15, wherein the ion packets exit the mass filter region by half the time between said turning point and said point of inflection.

17. The method of claim 14, wherein the turning point is a minimum at a phase of $-\pi/2$ and wherein said ions are positive ions.

18. The method of claim 14, wherein the turning point is a maximum at a phase of $+\pi/2$ and wherein said ions are negative ions.

* * * * *